US007478764B2

(12) United States Patent
Gopalan

(10) Patent No.: US 7,478,764 B2
(45) Date of Patent: Jan. 20, 2009

(54) FLUIDIC OSCILLATOR FOR THICK/THREE-DIMENSIONAL SPRAY APPLICATIONS

(75) Inventor: Shridhar Gopalan, Westminster, MD (US)

(73) Assignee: Bowles Fluidics Corporation, Columbia, MD (US)

( * ) Notice: Subject to any disclaimer, the term of this patent is extended or adjusted under 35 U.S.C. 154(b) by 182 days.

(21) Appl. No.: 11/230,948

(22) Filed: Sep. 20, 2005

(65) Prior Publication Data

US 2007/0063076 A1 Mar. 22, 2007

(51) Int. Cl.
*B05B 17/04* (2006.01)

(52) U.S. Cl. ..... 239/11; 239/589.1; 239/589; 239/DIG. 3; 239/DIG. 7; 137/813; 137/826

(58) Field of Classification Search ..... 239/589.1, 239/284.1, 284.2, 589, 590, 11, 101, DIG. 3, 239/DIG. 7; 137/826, 811, 836, 833, 14, 137/813

See application file for complete search history.

(56) References Cited

U.S. PATENT DOCUMENTS

| | | | | |
|---|---|---|---|---|
| 3,185,166 | A | 5/1965 | Horton | |
| 3,563,462 | A | 2/1971 | Bauer | |
| 3,791,584 | A | 2/1974 | Drew et al. | |
| 4,052,002 | A | 10/1977 | Stouffer | |
| 4,151,955 | A * | 5/1979 | Stouffer | 239/11 |
| 4,157,161 | A | 6/1979 | Bauer | |
| 4,231,519 | A | 11/1980 | Bauer | |
| 4,398,664 | A | 8/1983 | Stouffer | |
| 4,463,904 | A | 8/1984 | Bray | |
| 4,508,267 | A | 4/1985 | Stouffer | |
| 4,562,867 | A | 1/1986 | Stouffer | |
| 4,944,457 | A | 7/1990 | Brewer | |
| 5,035,361 | A | 7/1991 | Stouffer | |
| 5,181,660 | A | 1/1993 | Stouffer et al. | |
| 5,213,269 | A | 5/1993 | Srinath et al. | |
| 5,577,664 | A | 11/1996 | Heitzman | |
| 5,749,525 | A | 5/1998 | Stouffer | |
| 5,820,034 | A | 10/1998 | Hess | |
| 5,845,845 | A | 12/1998 | Merke et al. | |
| 5,906,317 | A | 5/1999 | Srinath | |
| 5,971,301 | A | 10/1999 | Stouffer et al. | |
| 6,186,409 | B1 | 2/2001 | Srinath et al. | |
| 6,240,945 | B1 | 6/2001 | Srinath et al. | |
| 6,253,782 | B1 | 7/2001 | Raghu | |
| 6,360,965 | B1 | 3/2002 | Clearman | |
| 6,805,164 | B2 | 10/2004 | Stouffer | |
| 7,014,131 | B2 * | 3/2006 | Berning et al. | 239/589.1 |
| 2003/0234303 | A1 | 12/2003 | Berning et al. | |

* cited by examiner

*Primary Examiner*—Dinh Q Nguyen
(74) *Attorney, Agent, or Firm*—Larry J. Guffey

(57) ABSTRACT

An improved fluidic insert, that operates on a pressurized liquid flowing through the insert to generate a jet of liquid that flows from said insert and into the surrounding gaseous environment to form a spray of liquid droplets, includes: (a) a member having top, front and rear outer surfaces, (b) a fluidic circuit located within this top surface and having an inlet, an outlet and a channel whose floor and sidewalls connect the inlet and outlet, and a barrier located proximate the outlet that rises from the channel floor and is configured such that: (i) it divides the channel in the region of the barrier into what are herein denoted as two power nozzles, and (ii) each of these nozzles has a downstream portion that is configured so as to cause the liquid flowing from the nozzles to generate flow vortices behind the barrier that are swept out of the outlet in such a manner as to control the lateral rate of spread of liquid droplets from the insert.

18 Claims, 9 Drawing Sheets

Section 14-14
(PRIOR ART)

Section 1-1

@ Time = T

@ Time = T+ΔT

FLUIDIC OSCILLATOR FOR THICK/THREE-DIMENSIONAL SPRAY APPLICATIONS

BACKGROUND OF THE INVENTION

1. Field of the Invention

This invention relates to liquid handling processes and apparatus. More particularly, this invention relates to new methods and apparatus for distributing the flow of liquid from a spray device.

2. Description of the Related Art

Fluidic inserts or oscillators are well known for their ability to provide a wide range of distinctive liquid sprays. The distinctiveness of these sprays is due to the fact that they are characterized by being oscillatory in nature, as compared to the relatively steady state flows that are emitted from standard spray nozzles.

FIG. 1 from U.S. Pat. No. 4,052,002 (Stouffer & Bray) demonstrates the oscillatory nature of the spray from a typical fluidic oscillator. It shows what can be considered to be the essentially temporally varying, two-dimensional, planar flow pattern (i.e., in the x-y plane of the oscillator, and assuming that the width of the oscillator in the z-direction is large in comparison to its throat or outlet dimension) of a liquid jet or spray that issues from the oscillator into a surrounding gaseous environment and breaks into droplets which are distributed transversely (i.e., in the y-direction) to the jet's generally x-direction of flow. Such spray patterns may be described by the definable characteristics of their droplets (e.g., the volume flow rate of the spray, the spray's area of coverage, the spatial distribution of droplets in planes perpendicular to the direction of flow of the spray and at various distances in front of the oscillator's outlet, the average droplet velocities, the average size of the droplets, and the frequency at which the droplets impact on an obstacle in the path of the spray).

A fluidic oscillator or insert is generally thought of as a thin, rectangular member that is molded or fabricated from plastic and has an especially-designed, uniform depth, liquid flow channel fabricated into either its broader top or bottom surface, and sometimes both (assuming that this fluidic insert is of the standard type that is to be inserted into the cavity of a housing whose inner walls are configured to form a liquid-tight seal around the insert and form an outside wall for the insert's boundary surface/s which contain the especially designed flow channels). See FIG. 2. Pressurized liquid enters such an insert and is sprayed from it.

Although it is more practical from a manufacturing standpoint to construct these inserts as thin rectangular members with flow channels in their top or bottom surfaces, it should be recognized that they can be constructed so that their liquid flow channels are placed practically anywhere (e.g., on a plane that passes though the member's center) within the member's body; in such instances the insert would have a clearly defined channel inlet and outlet.

Additionally, it should be recognized that these flow channels need not be of a uniform depth. For example, see U.S. Pat. No. 4,463,904 (Bray), U.S. Pat. No. 4,645,126 (Bray) and RE38,013 (Stouffer) for fluidic oscillators in which the bottom surfaces of these channels are discretely and uniformly sloped so as to impact the ways in which the sprays from these oscillators spread as the move away from the oscillator's outlet.

There are many well known designs of fluidic circuits that are suitable for use with such fluidic inserts. Many of these have some common features, including: (a) at least one power nozzle configured to accelerate the movement of the liquid that flows under pressure through the insert, (b) an interaction chamber through which the liquid flows and in which the flow phenomena is initiated that will eventually lead to the spray from the insert being of an oscillating nature, (c) an liquid inlet, (d) a pathway that connects the inlet and the power nozzle/s, and (e) an outlet or throat from which the liquid sprays from the insert.

Examples of fluidic circuits may be found in many patents, including U.S. Pat. No. 3,185,166 (Horton & Bowles), U.S. Pat. No. 3,563,462 (Bauer), U.S. Pat. No. 4,052,002 (Stouffer & Bray), U.S. Pat. No. 4,151,955 (Stouffer), U.S. Pat. No. 4,157,161 (Bauer), U.S. Pat. No. 4,231,519 (Stouffer), which was reissued as RE 33,158, U.S. Pat. No. 4,508,267 (Stouffer), U.S. Pat. No. 5,035,361 (Stouffer), U.S. Pat. No. 5,213,269 (Srinath), U.S. Pat. No. 5,971,301 (Stouffer), U.S. Pat. No. 6,186,409 (Srinath) and U.S. Pat. No. 6,253,782 (Raghu).

A key performance factor in many industrial applications for assorted spray devices, including fluidic oscillators, is the size of the area that the sprays from such devices can cover with liquid droplets—or alternatively, the lateral rate of spread of the fluid droplets as they proceed downstream. The degree of uniformity in the spatial distribution of these droplets can also be very important.

FIG. 3 shows the coordinate system which is used herein to describe how the spray from a fluidic oscillator spreads as it flows downstream from its origin at the oscillator's outlet. The centerline of the jet or spray is assumed to be in the x-direction and it exhibits both a lateral-horizontal spread in the x-y plane (referred to as the "width" of the spray and due primarily to the unique flow phenomena occurring within the insert that yields an essentially horizontally oscillating spray as shown in FIG. 1) which is defined by a horizontal fan angle, $\phi$, and a lateral-vertical spread in the x-z plane (referred to as the "thickness" or "throw" of the spray) which is defined by a vertical spread angle, $\theta$.

As one considers how to increase the lateral rate of spread of these liquid droplets and size of the area that they can cover, there is some prior art which is pertinent to this issue. For example, U.S. Pat. No. 4,151,955 (Stouffer), for what has come to be known as an "island" oscillator, discloses how one may cause the initial flow from a fluidic oscillator to take the form of a "sheet of liquid" or "sheet jet" that can be oscillated. This initial shape in the form of a sheet of liquid differs greatly from what normally is assumed to be the initially form of the flow from a fluidic oscillator—i.e., an essentially flat (i.e., very little thickness) but wide (i.e., large horizontal fan angle, $\phi$) jet or spray of liquid droplets. See FIG. 4 from U.S. Pat. No. 4,151,955 for an illustration of the flapping of such a sheet and how this impacts the area wetted by such a spray.

Using the coordinate system shown in FIG. 3, the flow pattern shown in FIG. 4 can be described as an initial flow from the oscillator in the shape of a flat sheet that lies in the x-y plane. The flow phenomena inside the oscillator causes this sheet to be non-uniformly oscillated in this x-y plane such that its ends flap up and down in the z-direction which causes the sheet to wet an area having dimensions which are denoted in FIG. 4 as "H×S." Thus, we have a somewhat rectangular area being wetted, rather than the relatively thin, wetted strip associated with the flow pattern shown in FIG. 1.

U.S. Pat. No. 4,151,955 reveals that this "rectangular area" rather than "strip" wetting phenomena is achieved by controlling how the flow oscillator's sidewalls or boundaries are contoured downstream of a fluidic oscillator's throat. FIGS. 5-7 from U.S. Pat. No. 4,151,955 show various configurations of what is referred to as an "island" oscillator. FIG. 5 illustrates that such an oscillator, which is distinguished, in part, by an expansion section downstream of its throat, which is identified by 35, 36 in FIG. 5, can be forced to yield an initial "sheet" jet if the extent of this section does not extend out beyond the dashed line 40. Locating the island (33) closer to the oscillator's outlet (34) is also reported to promote the formation of such a "sheet" jet.

FIG. 6 shows an island oscillator which has a section (identified by its sidewalls 101, 102 in FIG. 6) downstream of its throat (identified by 96, 97 in FIG. 6) in which the depth of this section has been reduced from what it was in the oscillator's oscillation chamber (93). See the cross-sectional view of this oscillator shown in FIG. 7. This change in this oscillator's configuration is also reported to promote the formation of a "sheet" rather than a "round" jet.

As fluidic oscillators have continued to be used in more types of applications, the opportunity has arisen to re-examine and improve upon their design, especially changing the geometry of their exits or outlets and the use of structures downstream of an oscillator's throat, as a way to improve upon the spreading characteristics of the sprays they emit. The results of our research in this area and the inventions that have come from our work are described herein.

3. Objects and Advantages

There has been summarized above, rather broadly, the prior art that is related to the present invention in order that the context of the present invention may be better understood and appreciated. In this regard, it is instructive to also consider the objects and advantages of the present invention.

It is an object of the present invention to provide the design for a new type of fluidic circuit that yields liquid sprays that are characterized by having enhanced thicknesses (i.e., the vertical rate of spread of such a spray's droplets is considerably greater than those of the usual "flat" sprays emitted by a wide range of fluidic circuits).

It is another object of the present invention to provide improvements in the design of the typical "island oscillator" so as to enable it to yield liquid sprays that are characterized by having enhanced thicknesses (i.e., the vertical rate of spread of such a spray's droplets is considerably greater than those of the usual "flat" sprays emitted by a wide range of fluidic circuits).

It is an object of the present invention to provide a liquid spray device that can enhance the rate of spread of the droplets that flow from such a spray device.

It is another object of the present invention to provide a liquid spray device that is especially well suited for cooling tower applications.

It is an object of the present invention to provide a clog-free, liquid spray device that is especially well suited for cooling tower applications.

It is a further object of the present invention to provide a liquid spray device that will provide clog-free performance in cooling tower applications while also providing equivalent or better cooling performance.

It is another object of the present invention to provide a liquid spray device that is especially well suited for cooling tower applications over a wide range of operating pressures (e.g., 1-5 psi) and flow rates (e.g., 10-90 gpm).

It is a still further object of the present invention to provide a liquid spray device that can uniformly spread liquid droplets over relatively large areas (4-8 sq. feet) located in close proximity (10-12 inches) to the device while operating at relatively large flow rates (25-85 gpm) and line pressures in the range of 0.5 to 6 psi.

It is an object of the present invention to provide a liquid spray device that can provide both horizontal and vertical rates of spread in the range of 70-120 degrees and 100-160 degrees, respectively, for the droplets that flow from such a spray device.

These and other objects and advantages of the present invention will become readily apparent as the invention is better understood by reference to the accompanying summary, drawings and the detailed description that follows.

SUMMARY OF THE INVENTION

Recognizing the need for the development of improved liquid spray devices, the present invention is generally directed to satisfying the needs set forth above and overcoming the disadvantages identified with prior art devices and methods.

In accordance with the present invention, an improved fluidic insert that operates on pressurized liquid flowing through it to generate a jet of liquid that flows into a surrounding gaseous environment and forms a spray of liquid droplets (in which the spray is characterized, in part, by its horizontal and vertical angles of spread) includes in a first preferred embodiment: (a) a member having top, front and rear outer surfaces and a centerline, (b) a fluidic circuit located within this top surface, with this fluidic circuit having an inlet, an outlet, a channel whose floor and sidewalls connect the inlet and outlet, and a barrier located proximate the outlet that rises from the channel floor, with the barrier configured such that: (i) it divides the channel in the region of the barrier into what are herein denoted as two power nozzles, (ii) each of the nozzles has a furtherest downstream portion whose cross section is characterized by a characteristic length L and the angle $\zeta$ that a centerline projecting normal to this cross section makes with the member's centerline, (iii) the barrier has a specified width that is characterized by the length W between the power nozzles' furtherest downstream portions, and (c) this is configured so as to control the lateral rate of spread of liquid droplets from the insert by specifying the parameters L, W and $\zeta$.

In a second preferred embodiment, an improved fluidic spray device includes: (a) a body having an internal surface that includes a cavity that serves as a flow passage for the pressurized liquid, (b) an inlet that allows liquid to flows into the body, (c) an outlet that allows liquid flows from the body, (d) a first barrier within the cavity that serves to separate the flow passage into at least two flow passages, with each of these flow passages having an end section that terminates proximate the body's outlet, and wherein each of these flow passage end sections is configured so as to cause the liquid flowing from these sections to generate flow vortices behind the barrier which are swept out of the outlet in such a manner as to cause the direction of the spray flowing from the outlet to be oscillated back and forth so as to establish the spray's horizontal angle of spread, and (e) a second barrier having a flow-diversion section that is configured and oriented so as to cause the spray from the outlet to be diverted in such a manner as to help establish the spray's vertical angle of spread.

Thus, there has been summarized above, rather broadly, the present invention in order that the detailed description that follows may be better understood and appreciated. There are, of course, additional features of the invention that will be described hereinafter and which will form the subject matter of the claims to this invention.

DESCRIPTION OF THE PREFERRED EMBODIMENT

Figure 1:
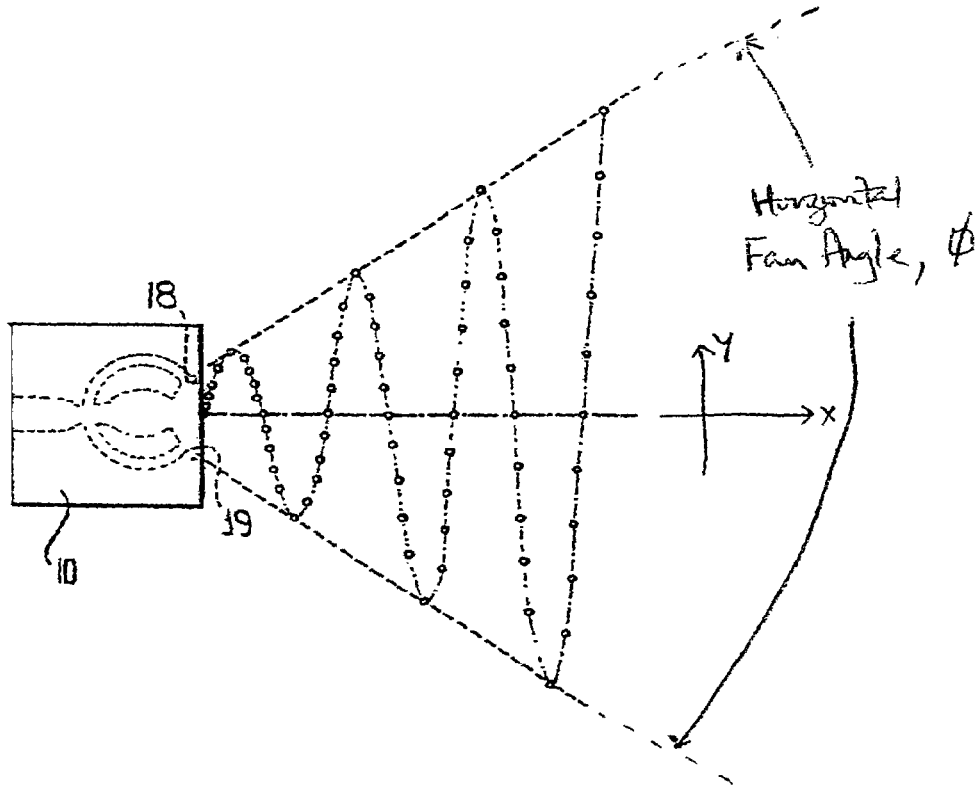
FIG. 1 (PRIOR ART)
FIG. 1 illustrates the two-dimensional, planar spray flow pattern yielded by an appropriately configured fluidic oscillator as disclosed in U.S. Pat. No. 4,151,955.

Before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

The task of inventing a fluidic oscillator that can give spays of liquid droplets having large rates of lateral spread (i.e., wet a large surface area at a distance that is relatively close to the oscillator's exit) is quite outside the realm of the flows that have generally been seen or achieved with fluidic oscillators. For example, the spray requirements for many automotive windshield applications are on the order of: flow rates of 0.1 gpm, operating pressures of 9 psig, uniform coverage with spray droplets of a target area located approximately 10 inches in front of the sprayer and having a target area which has a width of approximately 30 inches, but a height of only about 1-2 inches; Area ~0.09-0.2 ft.$^2$, wherein the horizontal fan angles are approximately 70-120 degrees, and the thickness angles are only approximately 2-6 degrees.

For many showerhead applications, the spray requirements are on the order of: flow rates of 2.5 gpm or less, operating pressures of 10 psig, uniform coverage with spray droplets of a target area located approximately 1 foot in front of the sprayer and having a target area of approximately 0.5 ft.$^2$, wherein the droplets have a mean diameter of approximately 2 mm and a velocity of greater than 4 m/sec. and the oscillation frequency is in the range of 30-60 cps.

The first embodiment of the present invention, in the form of a new fluidic insert or oscillator 1 for generating "thicker" sprays, is shown in its top view in FIG. 8. It is an improvement of the "island oscillator" shown in FIGS. 5-7.

Figure 5:
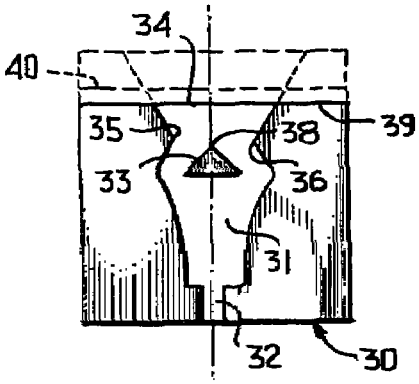
FIG. 5 (PRIOR ART)
FIG. 5 from U.S. Pat. No. 4,151,955 show an "island" oscillator which is distinguished by a section downstream of its throat which, if properly contoured, yields an initial "sheet" jet.
Figure 6:
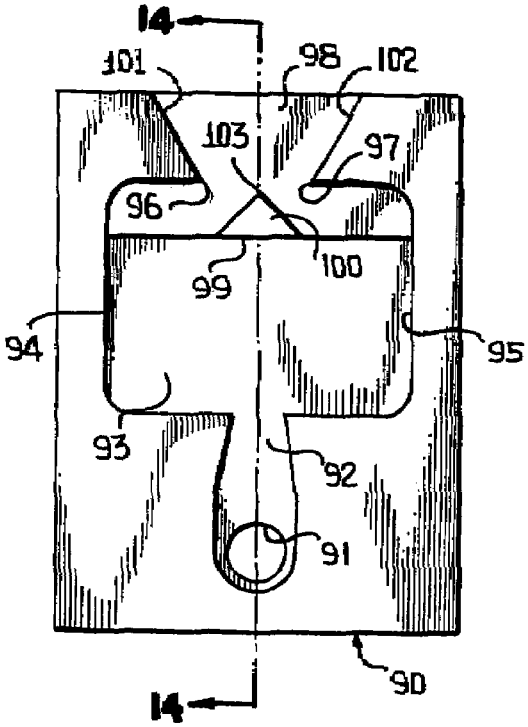
FIG. 6 (PRIOR ART)
FIG. 6 from U.S. Pat. No. 4,151,955 show another "island" oscillator which is distinguished by a section downstream of its throat which, if properly contoured, yields an initial "sheet" jet.
Figure 7:
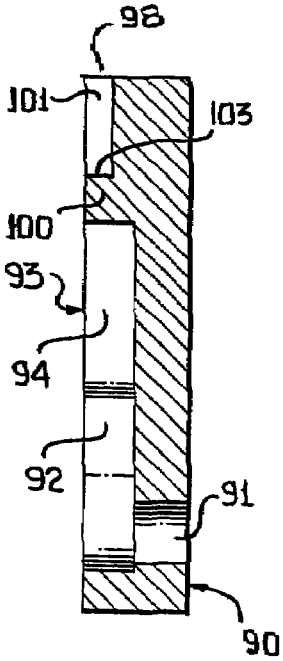
FIG. 7 shows a cross-sectional view of the oscillator shown in FIG. 6.

A key distinction between the present invention and that of the "island oscillators" shown in FIGS. 5-7 is appreciated when it is recognized that the furtherest downstream portions of most prior islands or flow obstructions are usually tapered in the downstream direction so that the flows around either side of the island converge back together smoothly so as to prevent a stagnation region behind the island. This is exactly the opposite of the situation that exists in the present invention where a flow stagnation region is intentionally created behind a barrier whose furtherest downstream portions are not tapered to a single point.

Figure 2:
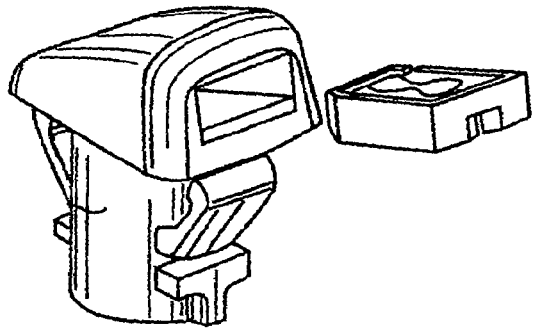
FIG. 2 (PRIOR ART)
FIG. 2 illustrates the typical housing or enclosure for a fluidic oscillator that was developed for automotive windshield washing applications.
Figure 8A:
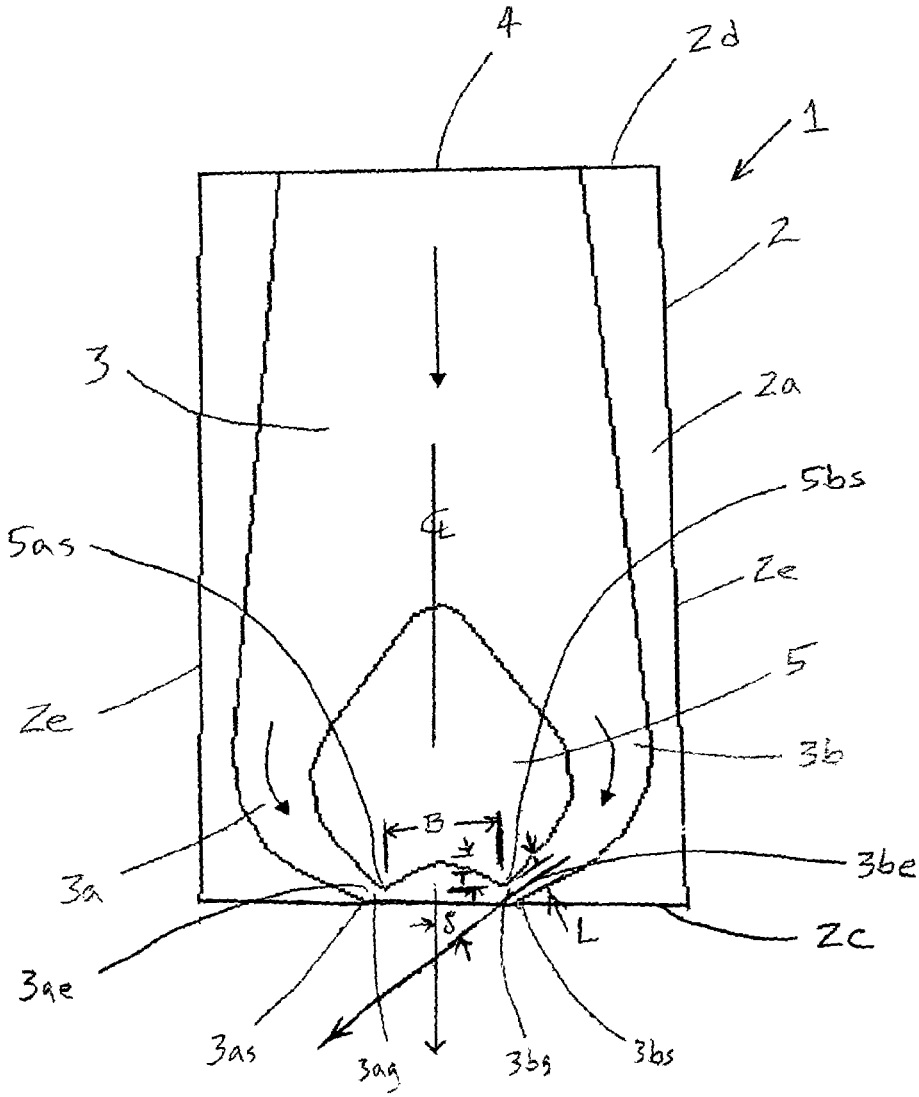
FIGS. 8A and 8B show, respectively, a top and a front view of a first preferred embodiment of the present invention.
Figure 8B:
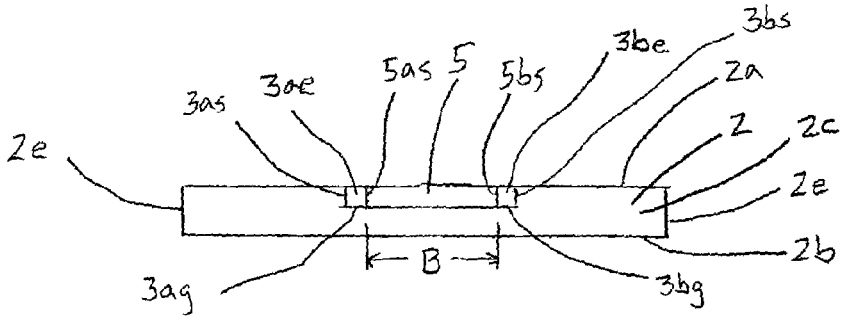

FIGS. 8A and 8B show the top surface 2*a* of a member 2 that has top 2*a*, bottom 2*b*, front 2*c*, rear 2*d* and side 2*e* outer surfaces. A novel fluidic circuit, consisting of precisely defined channels or flow passages 3, with its sidewalls and floor, through which a liquid may flow, has been fabricated or molded into the member's top surface. These channels become enclosed liquid flow passages when this member 2 is press fitted into a housing, as shown in FIG. 2, which has a cavity that has been especially configured to receive the member and in which a portion of the cavity's interior surface provides the top boundary surface needed by the member to turn its channels into enclosed fluid flow passages.

An inlet 4 that allows pressurized liquid to enter these circuits can be located anywhere (e.g., in the member's front face as shown in FIG. 8A, or thru its top, bottom or side surfaces) near the upstream end of the member's flow channel or flow passage. A barrier 5 is located within the member's channel 3, proximate its outlet, and rises from its floor so as to separate this flow passage into two power nozzle flow passages 3*a*, 3*b*. They are referred to as power nozzles since they are configured so as to reduce the surface area through which the liquid can flow and to thereby cause the movement of the liquid to accelerate.

The furtherest downstream ends 3*ae*, 3*be* of these power nozzles 3*a*, 3*b* have a perimeter that consists of the channel or power nozzle outer sidewalls 3*as*, 3*bs*, the gaps 3*ag*, 3*bg* from these outer sidewalls 3*as*, 3*bs* across the bottom of channels' floor at these ends and to the nearest sidewalls 5*as*, 5*bs* of the downstream end of the barrier 5. The distance between the points of the power nozzles' furtherest downstream sidewalls 3*as*, 3*bs* can be considered to define a throat for this fluidic circuit.

These power nozzle ends 3*ae*, 3*be* are defined, in part, by a characteristic length, L (e.g., the length of width of the gaps 3*ag*, 3*bg*). Similarly, the downstream end of the barrier 5 can be considered to be defined, in part, by a characteristic width, B (e.g., the distance between the barrier's furtherest downstream sidewalls 5*as*, 5*bs*) and an "interaction recess" depth, T. See FIGS. 8A and 9A. This "interaction recess" behind the barrier is formed, in large part, because the barrier's lateral downstream edges 5*as*, 5*bs* are not in the same downstream plane as the point 5*c* where the barrier's downstream edge intersects the member's centerline. This downstream edge centerpoint 5*c* is actually upstream of the barrier's lateral downstream edges by a depth, T.

Figure 3:
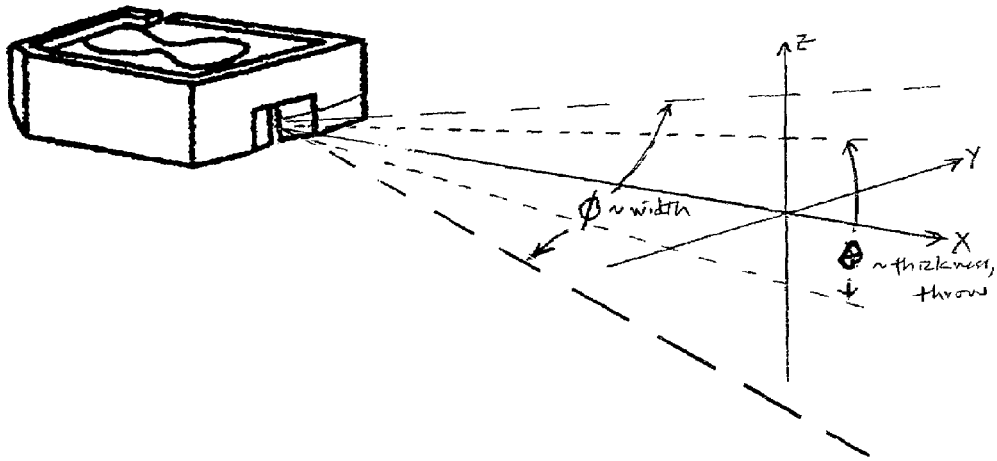
FIG. 3 illustrates the coordinate system which is being used herein to describe the spray from a fluidic oscillator.
Figure 4:
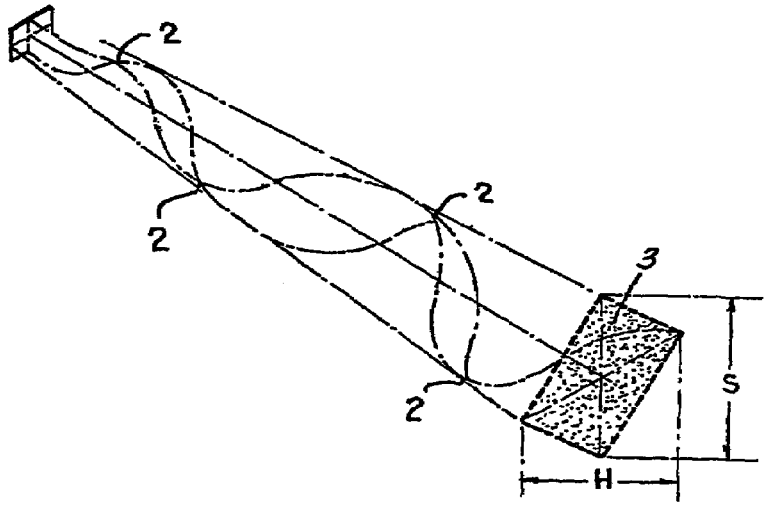
FIG. 4 PRIOR ART
FIG. 4 from U.S. Pat. No. 4,151,955 illustrates the flapping of a "sheet" jet and the area wetted by such a spray.

The discovery that led to the present invention is the finding that when the ratio of these the lengths, B/L or T/L, are in various ranges, the rate at which the spray that issues from such a fluidic circuit spreads vertically (i.e., in the x-z plane, see FIG. 3) can be greatly increased.

For example, when the ratio B/L is in the range of 2-10 or the ratio T/L is in the range 0.5-4, and for a wide range of flow conditions, the vertical spread angles, θ, of the resulting sprays can be greatly increased (i.e., from 1-2 degrees to>10 degrees).

It has also been found that a spray's vertical spread angle can be influenced by the direction in which these power nozzles direct their flow with respect to the centerline of the fluidic. See the right hand, power nozzle 3*be* shown in FIG. 8A, where this angle is denoted by the symbol ζ.

Power nozzle directional angles, ζ, of 10-80 degrees, when used in association with barriers having widths in the range of B/L equal 2-10, have been found to be especially effective in increasing the vertical spread angles, θ, of the sprays issuing from such fluidic oscillators.

Figure 9A:
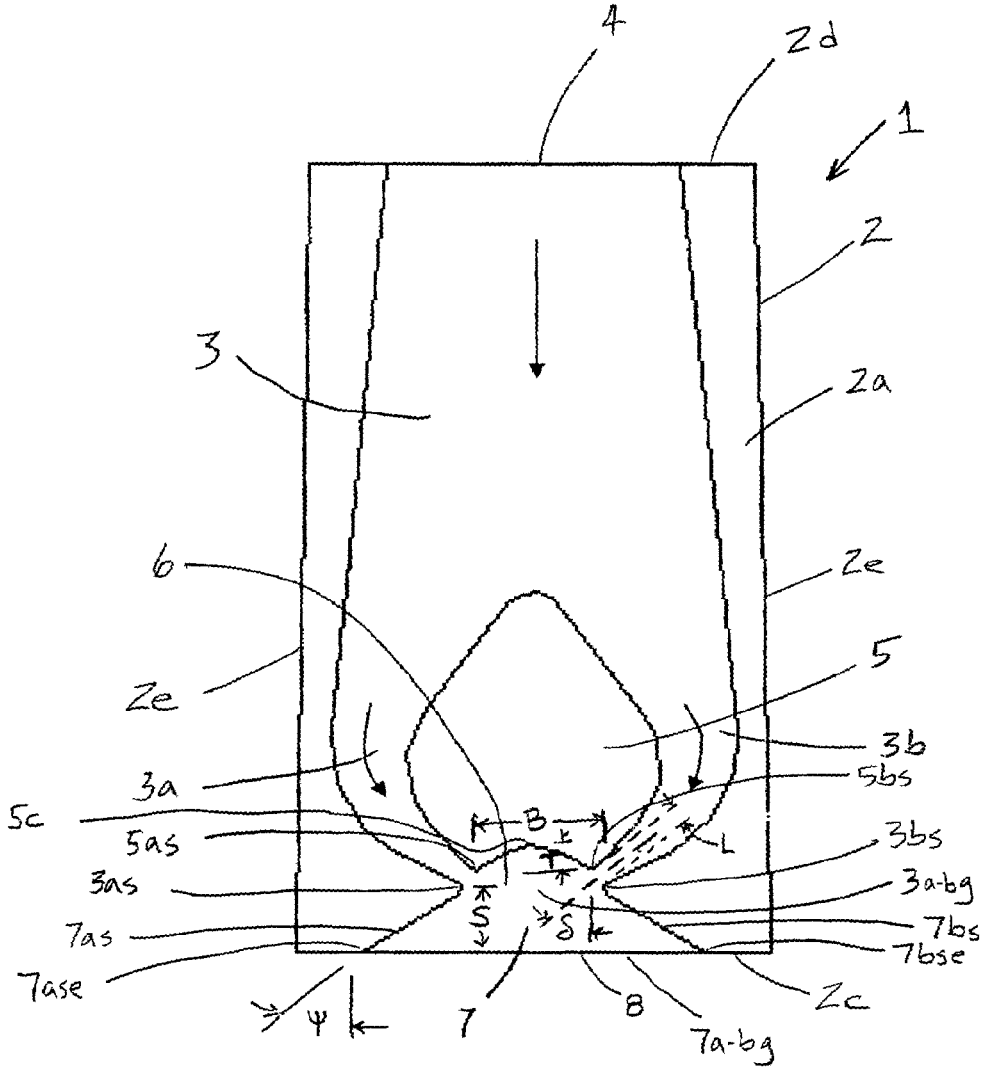
FIGS. 9A and 9B show, respectively, a top and a front view of a second preferred embodiment of the present invention.
Figure 9B:
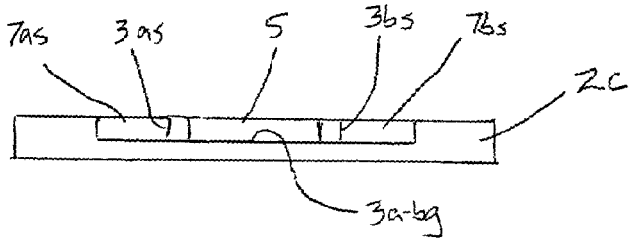

FIGS. 9A and 9B show, respectively, a top and a front view of a second preferred embodiment of the present invention. This embodiment differs from that shown in FIGS. 8A-8B by its having an expansion section 7 downstream of the member's throat 6.

In this embodiment, three portions of this throat 6 are seen to be comprised of the ends of the power nozzle sidewalls 3*as*, 3*bs* and the gap 3*a-bg* across the bottom of the channel which lies between these sidewalls 3*as*, 3*bs*. See FIG. 9B. The fourth and final portion of an enclosed-flow-passage throat would be its upper portion that would be provided by the adjoining surface of the liquid-tight cavity of the housing into which the member would be inserted.

The expansion section 7 consists of sidewalls 7*as*, 7*bs* that are angled out from the member's centerline at a divergence angle of ψ. The length of this expansion section as measured along the member's centerline is denoted by the distance S. In trying to characterize this expansion section, it proves useful to describe it in terms of its length S and the outward directed angle of its sidewalls, ψ.

The outlet 8 for this member's flow passage is seen to lie in the member's front face. Three portions of this outlet include the ends 7*ase*, 7*bse* of the expansion section sidewalls 7*as*, 7*bs* and the gap 7*a-bg* across the bottom of the channel which lies between these sidewall ends 7*ase*, 7*bse*. The fourth and final portion of an enclosed-flow-passage outlet would be its upper portion that would be provided by the adjoining surface of the liquid-tight cavity of the housing into which the member would be inserted.

Experiments with variously shaped expansion sections have shown that extending the length of the expansion section too far, for a specified divergence angle ψ, can diminish the initial tendency of such sections to increase the thickness of the sprays coming from such fluidic oscillators. For example, when ψ is in the range of 20-80 degrees, then restricting the length of the expansion section such that the ratio S/L is in the range of 2-10 is seen, for a wide range of flow conditions, to yield sprays having increased vertical spread angles, θ (i.e., from 1-2 degrees to>10 degrees).

With an improved understanding of the effects of such fluidic oscillators' various geometric parameters on the spreading characteristics of the sprays that issue from them, it is now possible to design an assortment of fluidic oscillators to meet specialized operational needs. For example, to create at a flow rate of about 100 ml/min (~25 gpm), what is referred to as a "barrier" spray (i.e., a relatively narrow, horizontal fan angle=30 degrees, but thick, vertical spread angle=10 degrees, spray, the fluidic oscillator shown in FIGS. 9A-B has proven to be a good choice when it is scaled such that L=0.4 mm, B/L=6, S/L=3.5, T/L=1.5, ζ=40 degrees and ψ=45-60 degrees.

As previously mentioned, it is possible to consider the fluidic circuits disclosed in FIGS. 8A-B and 9A-B as not being embedded in the top surface of a member that must be inserted into a housing's cavity, but as forming totally enclosed flow passages that are oriented around the centerline of a body that forms part of a fluidic device which has a clearly defined flow inlet and outlet.

Figure 10:
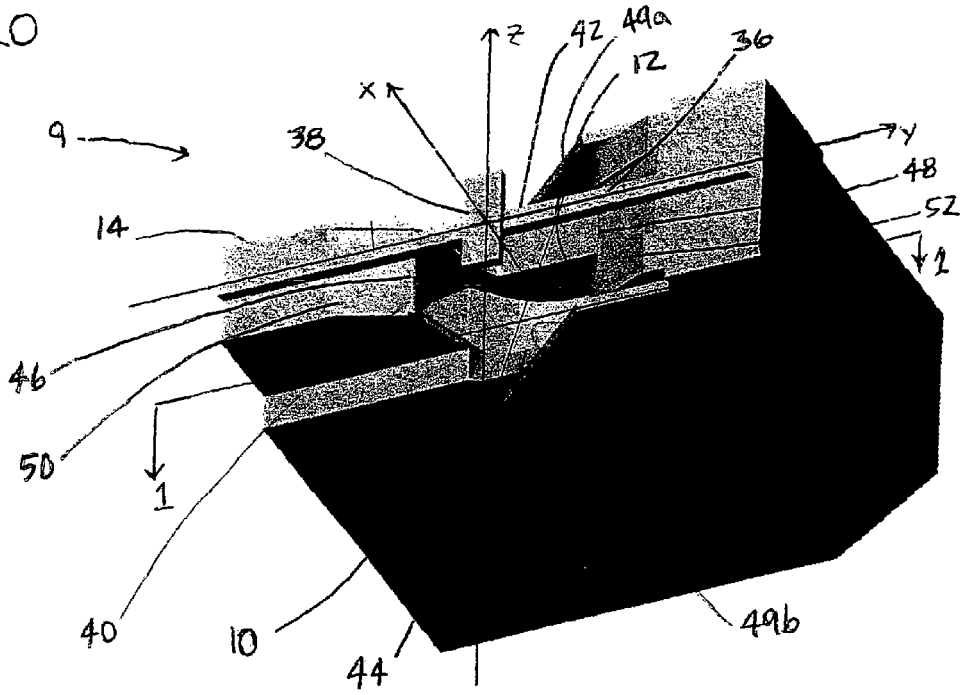
FIG. 10 shows a perspective view of a third preferred embodiment of the present invention.
Figure 11:
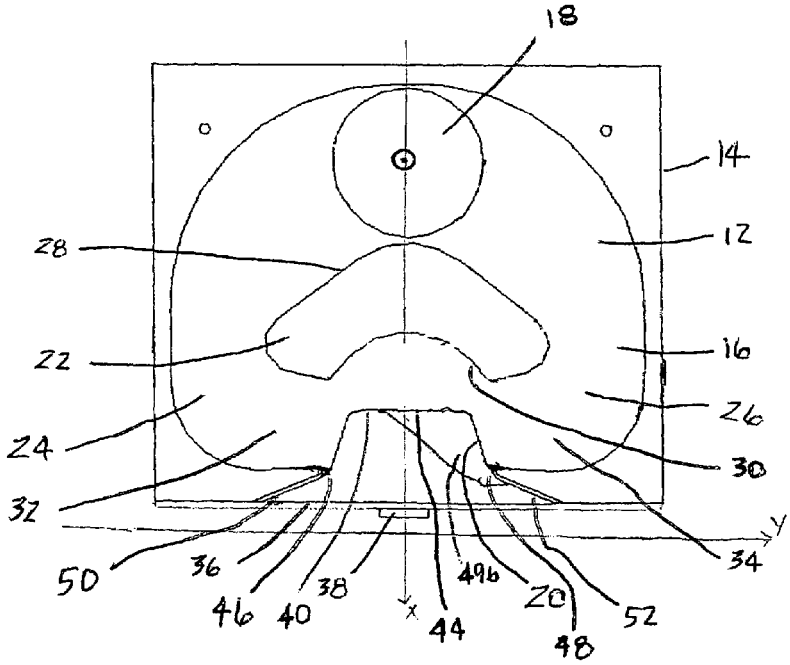
FIG. 11 shows a downward-directed cross sectional view of the preferred embodiment shown in FIG. 10.

FIGS. 10 and 11 show, respectively, a perspective and a downward-directed cross sectional view of such a fluidic device 9 that is another embodiment of the present invention. Also shown in these figures is a x-y-z coordinate system which serves to clarify the discussion herein of the flow in and from this device.

The device shown in FIGS. 10-11 is for a cooling tower application. This is an especially challenging task because of the areas to be wetted (4-8 ft.$^2$ at a distance of about 1 foot in front of the nozzle), the operational flow rates (25-85 gpm) and pressures (6 psi) used in such devices. Thus, the consequent required rates of spread of the sprays from such devices need to be far outside the capable range of most of the typical spraying devices, especially those that utilize the better known forms of fluidic oscillators.

In a cooling tower application of interest, water, that is hot because it's been used to take heat from a refrigerant and which is to be cooled in the tower, is sprayed or distributed over a media surface that has staggered/straight channels from which the water drips. A counter flow of air that's cooler than the hot water is induced through these channels by a fan. Within the channels, the water film on the media and air come in contact resulting in local evaporation at the air-water interface that serves to cool the water.

In order for the water to be cooled most efficiently, the water film on the media should be as uniform as possible. Heavy loading of water in some parts of the media and light loading in other parts will lead to inefficient cooling. More uniform water distributions on the media are achieved by spraying the water on the media by the use of nozzles.

In many cooling towers, the spray branches of nozzles are located above the media. Depending on the nozzle design, nozzle flow rates may vary from 25-85 gallons per minute (gpm) and at line pressures of up to 6 pounds per square inch (psi). The nozzles are often required to spray relatively large areas (e.g., about 4-8 sq. ft) which are located only a comparatively short distance in front of the nozzles (e.g., in most cases: 10-12 inches, and in some: up to 22 inches). These operating conditions can make it very difficult to obtain a wide-angle, full-coverage and uniform distribution of spray on the media.

This device shown in FIGS. 10-11 is seen to consist of: (a) a housing or body 10 which has an internal surface 12 and an external surface 14 and a longitudinal centerline which aligns with the x-axis, this internal surface is seen to form a cavity or channel 16 that serves as a flow passage, (b) an inlet 18 that provides an opening by which liquid may flow into the body, (c) an outlet 20 that provides the opening by which liquid flows from this body, (d) an island or a first barrier 22 within the cavity that serves to separate the initial passage into two power nozzles or secondary flow passages 24, 26, with this barrier having an upstream portion 28 and a downstream portion 30 and each of these flow passages having an end section 32, 34 that terminates proximate the housing' outlet 20, and (e) a center bar or second barrier 36 that has a cross bar or flow-diversion section 38, with this center bar attaching to the body so as to position the cross bar 38 just downstream of the outlet 20 so that it can serve to spread the liquid jet that comes from the device along the housing's vertical or z-axis.

More information on possible alternative designs for the body's cavity and the configuration of the present embodiment's flow passages can be found in U.S. Pat. No. 6,253,782 which discloses a fluidic oscillator whose "fluidic circuit" can be considered to be "somewhat" similar to that shown in FIG. 11 and which is referred to by its creators as a "mushroom oscillator." However, it should be noted that a significant difference between these fluidic or fluidic flow circuits is that the present embodiment, as shown in FIG. 11, does not have the fully developed interaction chamber that is characteristic of the "mushroom" and many other fluidic circuits.

The end sections 32, 34 of the passages or power nozzles of FIG. 11 are seen to actually comprise a part of the body's outlet 20. Nevertheless, it should be noted that the Assignee for the present embodiment and U.S. Pat. No. 6,253,782 are one and the same, and that the teachings of their earlier patent should be considered as incorporated into the present disclosure by this reference to the U.S. Pat. No. 6,253,782.

In terms of the configuration of the outlet 20 of the present embodiment, it is seen to have a quite complex shape. Before trying to describe this shape, it proves useful to note, see FIG. 10, that the body's longitudinal centerline will be approximately equivalent to the centerline of the spray from issues from the body.

The outlet 20 has a perimeter that defines its boundary edge 40. This edge has a top 42 and a bottom 44 portion and two sidewall portions 46, 48. It should be noted that these sidewall portions 46, 48 are located at a further distance from the body's inlet than the top 42 and bottom 44 portions so as to promote the vertical spreading of the spray.

Additionally, it should be noted that the vertical spread of the spray can be further controlled by the addition of top 49*a* and bottom 49*b* plates which serve to further define the shape of the outlet's perimeter 40 in the x-y planes which lie fartherest from the spray's centerline.

To give a better idea of the geometry of this outlet 20, it can be noted that if the area of each flow passage end section 32, 34 is approximately shaped as a square whose side has a length of approximately L, then it has been experimentally determined that an appropriate distance to move the top 42 and bottom 44 portions of the outlet boundary edge upstream (so as to enhance the resulting spray's throw) is in the range of 0.2-2.0 L.

It should also be noted that we speak of these passage end sections 32, 34 as being "square," although we note that their cross-sectional shape could take on any one of a number of geometric shapes. For example, they could be circular so as to maintain a minimum length scale and increase the velocity resulting in better low pressure performance.

To put some actual dimensions to the embodiment shown in FIGS. 10-11, it can be noted that for the cooling tower operating parameters previously cited (i.e., 4-8 ft.$^2$ at a distance of about 1 foot in front of the nozzle, with 25-85 gpm at 6 psi), the length L will be approximately one inch. This relatively large opening is seen to be quite helpful for preventing clogging in such nozzles.

While this opening is relatively large, it should also be noted that the overall dimensions of this embodiment (e.g., with L=1 inch, the distance between the centerline of the inlet port 18 and the location of the flow-diversion section 38 is only about 4 inches, while the overall width of the body 10 is about 6 inches) are relatively small for the amount of water that can be pumped through such a nozzle (e.g., 85 gpm). Thus, one can conclude that this embodiment is of a compact design.

Downstream sidewalls 50, 52 also can be seen to be attached to each sidewall portion of the outlet's boundary edge. These sidewalls are sloped outwards so as to form an expansion section whose configuration serves to further control the horizontal spread of the spray. Slope angles that have proved useful for these sidewalls are in the range of 20-80 degrees. Meanwhile, the length of these sidewalls will generally be in the range of 0.2-8 L.

A closer examination of FIG. 10-11 reveals that the flow-diversion section 38 is located in the plane defined by the fartherest downstream extent of the sidewalls 50, 52. In terms of the sizing of this section 38, it can be characterized by noting that if it is assumed to have a characteristic dimension, then this section has been found to be most advantageous for promoting the vertical spreading of the spray when this section characteristic dimension is in the range of 0.25-2.0 L.

Figure 12:
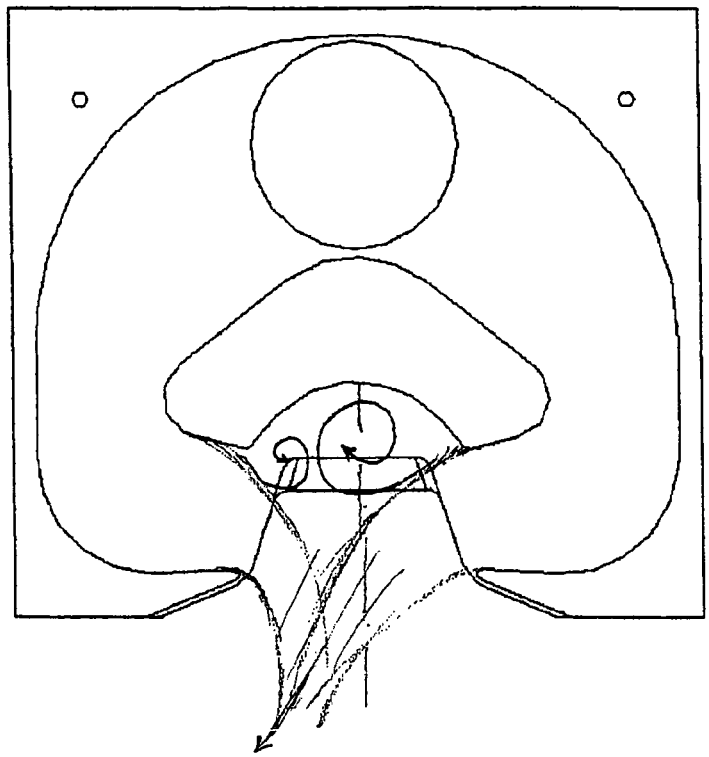
FIG. 12 illustrates the flow phenomena occurring within the embodiment shown in FIG. 11 at the time T.
Figure 13:
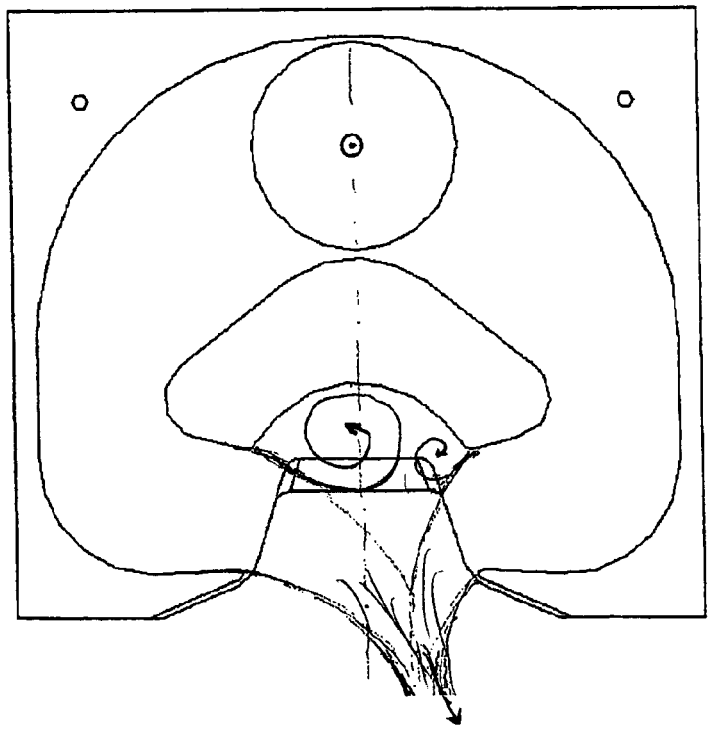
FIG. 13 illustrates the flow phenomena occurring within the embodiment shown in FIG. 11 a short time later at the time T+ΔT.

An attempt to illustrate the flow phenomena associated with the fluidic oscillators or the present invention is shown in FIGS. 12-13. It can be seen that the power nozzle end sections are configured and oriented so as to cause the liquid flowing from them to generate vortices behind the barrier's downstream portion. These vortices are then swept downstream in such a manner as to cause the direction of the liquid jet to be oscillated back and forth in the x-y plane so as to establish the horizontal angle of spread, $\phi$, or the width of this spray. Meanwhile, these vortices also cause the spray to be spread in the x-z plane so as to help establish the spray's vertical spread angle, $\theta$, or its "throw" or "thickness."

Figure 14:
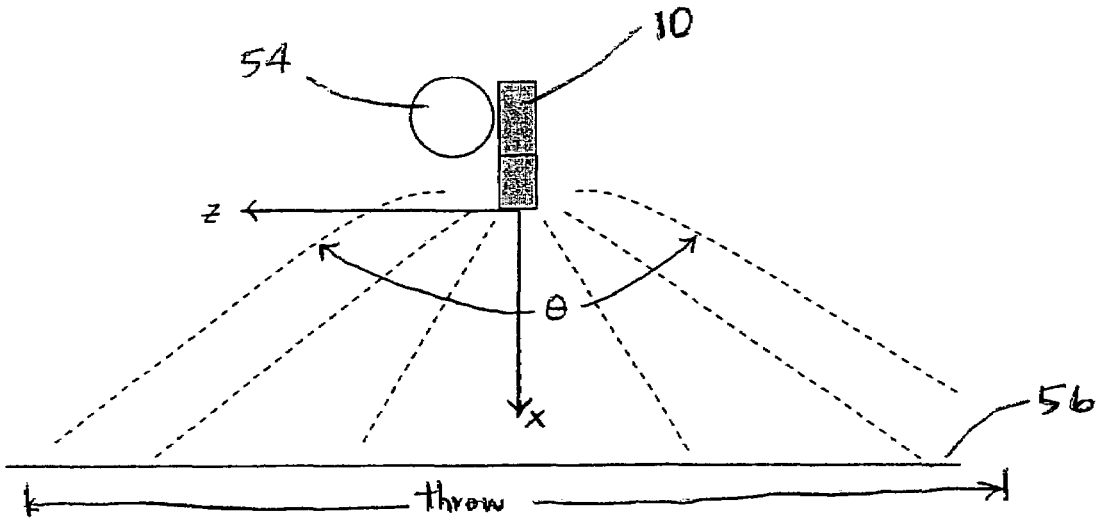
FIG. 14 shows a typical vertical spread angle for a spray emitted by the preferred embodiment shown in FIGS. 10-11.
Figure 15:
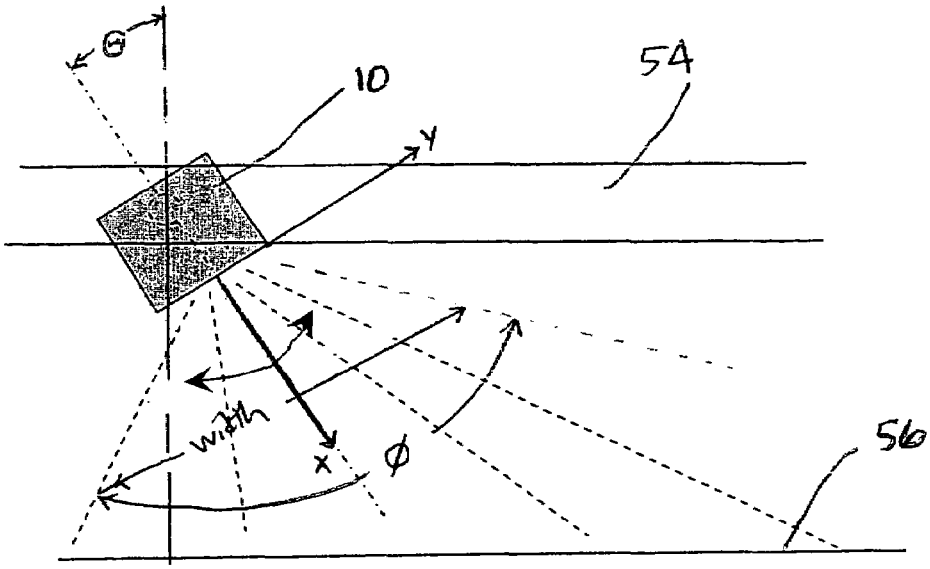
FIG. 15 shows a typical horizontal spread angle for a spray emitted by the preferred embodiment shown in FIGS. 10-11.

FIGS. 14-15 illustrate the, respective, typical vertical and horizontal spread angles for the sprays emitted by the preferred embodiment shown in FIGS. 10-11. The performance of this device is illustrated by noting that, when the characteristic length of the fluidic device shown in FIGS. 10-11 is approximately one inch and its outlet boundary edge top 42 and bottom 44 portions are upstream a distance of approximately 0.7 L, its downstream sidewalls 50, 52 have a characteristic length of approximately 0.5 L and an outward slope angle of about 45 degrees, and the device is operating at 50 gpm and 2.5 psi, typical spray dimensions in a plane located about 1 ft. in front of the device are: throw=3.5-5 ft. and width=14-24 inches.

It should be noted that the uniform wetting of such a large area cannot be achieved with any of the prior art spray devices. It is only the capability of the present embodiment to create a spray with such a large throw and then to uniformly spread it over such a relatively large width that allows for such wetting achievements.

In the installation shown in FIGS. 14-15, the body 10 is mounted on a header 54 at an angle $\Theta$ from a line that extends perpendicularly from the surface of the media 56 which is to be uniformly sprayed with the to-be-cooled water that is sprayed from the header. The use of the installation angle $\Theta$ provides a means to expand the width of the media that can be covered by the oscillating spray emitted from the spray device 9. For many cooling tower applications, installation angles $\Theta$ in the range of 25-40 degrees have proven useful in the task of wetting areas of 4-8 ft.$^2$ at a distance of about 1 foot in front of the fluidic device.

It should also be noted, from FIGS. 14-15, that the body 10 is, in the present invention, mounted on the side, rather than at the bottom, of the header 54 pipe. This proves to be advantages since any debris that lies or moves in close proximity to the bottom of the header pipe is less likely to block or interfere with the liquid that flows from such a header's side (or higher) mounted outlet, as opposed to a bottom mounted outlet.

Figure 16:
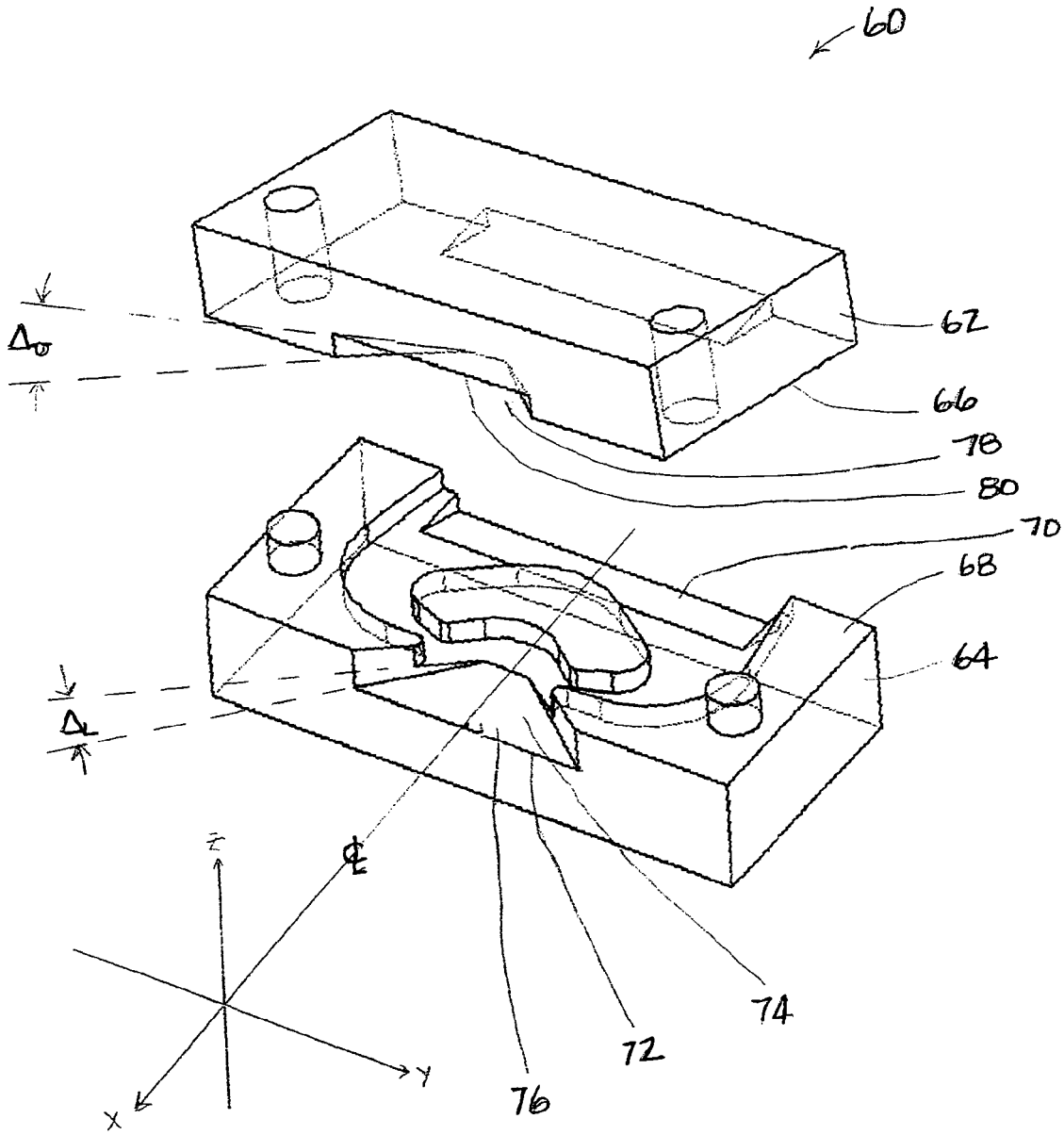
FIG. 16 shows an exploded view of a fourth preferred embodiment of the present invention.

FIG. 16 shows an exploded view of a fluidic device 60 that is a fourth preferred embodiment of the present invention. It consists of a top or lid 62 portion and a bottom or fluidic insert 64 portion. The bottom portion is constructed in the usual form that we associate with a fluidic insert (i.e., thin, rectangular member that is molded or fabricated from plastic and has an especially-designed, liquid flow channel fabricated into its broader top surface). The lid has a bottom surface 66 that mates with the insert's top surface 68 so as to form a liquid-tight seal and form the top surface of the insert's flow channel.

Pressurized liquid enters this insert through its inlet 70 and is sprayed from its outlet 72. The nature of the fluidic circuit for this device is similar to that shown in FIGS. 9*a*-9B.

However, it is notably different in that it has an expansion section 74 which, has a bottom surface 76 that slopes or tapers downward, at an angle $\Delta_L$, away from the device's centerline. Similarly, the top portion 62 also has an expansion section 78 which has a top surface 80 that is tapered or sloped away from the device's centerline at an angle $\Delta_U$.

Experimental results for such configurations have shown that these expansion section tapers serve to increase the thickness or throw of the resulting spray. The spray output from this device is seen to be much more three-dimensional. The area that it wets on a plane perpendicular to the device's centerline has a shape that is much more rectangular or even square-like than the typical thin, horizontal strip-shaped wetted area which is characteristic of the sprays from many fluidic oscillators.

An example of the use of these expansion section tapers can be seen in the design of a fluidic device which is to be used in what is commonly referred to a "trigger spray" container (e.g., a bottle of cleaning fluid which one applies by squeezing a trigger that issues a very small, flow rate spray of the liquid in the direction at which the bottle's nozzle is oriented). Assuming that a flow rate of about 0.05 gpm is desired, taper angles of about $\Delta$=20 degrees in both the top and bottom portions have been shown to yield sprays that have a lateral vertical spread angle, $\theta$, of almost this same degree (i.e., $\theta=\Delta_U+\Delta_L$). In general, taper angles of 5-45 degrees have been found to be useful in controlling the shape of the emitted spray.

While the tapers in the above embodiment are shown as both being sloped away from the centerline, it is recognized that many other combinations of slopes (e.g., both sloped inward toward the centerline, one sloped inward & the other sloped outward) may be advantageous to control or modify the cross-sectional shape of the spray that is omitted from such a fluidic device. All of these combinations are considered to come within the scope of the present invention.

As previously mentioned, although it is more practical from a manufacturing standpoint to construct these inserts as thin rectangular members with flow channels in their top or bottom surfaces, it should be recognized that they can be constructed so that their liquid flow channels are placed practically anywhere (e.g., on a plane that passes though the member's center) within the member's body; in such instances the insert would have a clearly defined channel inlet and outlet.

The foregoing is considered as illustrative only of the principles of the invention. Further, since numerous modifications and changes will readily occur to those skilled in the art, and because of the wide extent of the teachings disclosed herein, the foregoing disclosure should not be considered to limit the invention to the exact construction and operation shown and described herein. Accordingly, all suitable modifications and equivalents of the present disclosure may be resorted to and still considered to fall within the scope of the invention as hereinafter set forth in the claims.

I claim:

1. A fluidic oscillator that operates on a pressurized liquid flowing through said oscillator to generate an exhaust flow in the form of a spray of liquid droplets into a surrounding gaseous environment, said oscillator comprising:

an inlet for said pressurized liquid, an outlet from which said exhaust flows, a channel connecting said inlet and outlet and having a floor, sidewalls and a centerline, a throat situated at a point between said inlet and outlet and formed by the converging of said channel sidewalls, a barrier located proximate said throat and rising from said channel floor so as to divide said channel in the region of said barrier into what are herein defined as two power nozzles, each of said power nozzles having a furtherest downstream portion whose cross section is characterized by a herein defined length L and the herein defined angle $\zeta$ that a centerline projecting normal to said cross section makes with said channel centerline, wherein said barrier having a specified width that is characterized by the herein defined length B between the furtherest downstream portions of said barrier, an interaction recess on the downstream side of said barrier and proximate said throat that is characterized by a herein defined depth T, an expansion section formed by said channel sidewalls diverging downstream of said throat, with the furtherest downstream portions of said expansion section sidewalls forming said oscillator outlet, wherein said expansion section characterized by a herein defined downstream length S and the herein defined angle $\psi$ that said expansion section sidewalls make with said channel centerline, wherein said oscillator is configured so as to control the lateral rate of spread of said liquid droplets from said oscillator by specifying the parameters L, B, $\zeta$, T, S and $\psi$.

2. The fluidic oscillator as recited in claim 1 wherein said oscillator is further configured so that T/L is in the range of 0.5-4.

3. The fluidic oscillator as recited in claim 1 wherein said oscillator is configured so that B/L is in the range of 2-10.

4. The fluidic oscillator as recited in claim 3 wherein said oscillator is configured so that $\zeta$ is in the range of 20 to 80 degrees.

5. The fluidic oscillator as recited in claim 1 wherein said oscillator is configured so that $\zeta$ is in the range of 20 to 80 degrees.

6. The fluidic insert as recited in claim 1 wherein:

said expansion section bottom surface having a taper with respect to said member centerline that is characterized by a taper angle $\Delta$ as herein defined, and said circuit is further configured so that $\Delta$ is in the range of 5-45 degrees.

7. The fluidic oscillator as recited in claim 1 wherein said oscillator is configured so that S/L is in the range of 2-10.

8. The fluidic oscillator as recited in claim 7 wherein said oscillator is configured so that $\psi$ is in the range of 20 to 80 degrees.

9. The fluidic oscillator as recited in claim 1 wherein said oscillator is configured so that $\psi$ is in the range of 20 to 80 degrees.

10. A method for making a fluidic oscillator that operates on a pressurized liquid flowing through said oscillator to generate an exhaust flow in the form of a spray of liquid droplets into a surrounding gaseous environment, said method comprising the steps of:

providing an inlet for said pressurized liquid, providing an outlet from which said exhaust flows, providing a channel connecting said inlet and outlet and having a floor, sidewalls and a centerline, providing a throat situated at a point between said inlet and outlet and formed by the converging of said channel sidewalls, providing a barrier located proximate said throat and rising from said channel floor so as to divide said channel in the region of said barrier into what are herein denoted as two power nozzles, one of said power nozzles being situated on each side of said throat, wherein each of said power nozzles having a furtherest downstream portion whose cross section is characterized by a herein defined length L and the herein defined angle $\zeta$ that a centerline projecting normal to said cross section makes with said channel centerline, wherein said barrier having a specified width that is characterized by the herein defined length B between the furtherest downstream portions of said barrier, providing an interaction recess on the downstream side of said barrier and proximate said throat, wherein said recess characterized by a herein defined depth T, providing an expansion section formed by said channel sidewalls diverging downstream of said throat, with the furtherest downstream portions of said expansion section sidewalls forming said oscillator outlet, wherein said expansion section characterized by a herein defined downstream length S and the herein defined angle $\psi$ that said expansion section sidewalls make with said channel centerline, wherein said oscillator is configured so as to control the lateral rate of spread of said liquid droplets from said oscillator by specifying the parameters L, B, $\zeta$, T, S and $\psi$.

11. The method as recited in claim 10 wherein said oscillator is further configured so that T/L is in the range of 0.5-4.

12. The method as recited in claim 10 wherein said oscillator is configured so that B/L is in the range of 2-10.

13. The method as recited in claim 12 wherein said oscillator is configured so that $\zeta$ is in the range of 20 to 80 degrees.

14. The method as recited in claim 10 wherein said oscillator is configured so that $\zeta$ is in the range of 20 to 80 degrees.

15. The method as recited in claim 10 wherein:

said expansion section bottom surface having a taper with respect to said member centerline that is characterized by a taper angle $\Delta$ as herein defined, and said circuit is further configured so that $\Delta$ is in the range of 5-45 degrees.

16. The method as recited in claim 10 wherein said oscillator is configured so that S/L is in the range of 2-10.

17. The method as recited in claim 16 wherein said oscillator is configured so that $\psi$ is in the range of 20 to 80 degrees.

18. The method as recited in claim 10 wherein said oscillator is configured so that $\psi$ is in the range of 20 to 80 degrees.

* * * * *